US010337203B1

(12) United States Patent
Tomsky

(10) Patent No.: US 10,337,203 B1
(45) Date of Patent: Jul. 2, 2019

(54) OUTDOOR UMBRELLA MOUNT

(71) Applicant: Craig Tomsky, Clinton Township, NJ (US)

(72) Inventor: Craig Tomsky, Clinton Township, NJ (US)

( * ) Notice: Subject to any disclaimer, the term of this patent is extended or adjusted under 35 U.S.C. 154(b) by 0 days.

(21) Appl. No.: 16/165,213

(22) Filed: Oct. 19, 2018

(51) Int. Cl.
*E04H 12/22* (2006.01)
*E04H 15/28* (2006.01)

(52) U.S. Cl.
CPC ..... *E04H 12/2269* (2013.01); *E04H 15/28* (2013.01)

(58) Field of Classification Search
CPC ..... E04H 12/22; E04H 12/2269; E04H 15/28; A45B 2023/0012; A45B 2023/0025; A45B 2200/109
See application file for complete search history.

(56) References Cited

U.S. PATENT DOCUMENTS 716,968 A * 12/1902 Warner ..... E04H 12/2269 52/298
1,564,703 A 12/1925 Nichols
3,802,112 A * 4/1974 Banner ..... A01K 97/10 248/514
5,573,122 A 11/1996 Williams
6,202,369 B1 * 3/2001 Partee ..... E04H 12/2269 248/523
6,435,469 B1 8/2002 Ratcliff et al.
6,953,180 B1 * 10/2005 Ruvalcaba ..... E04H 12/2215 135/118
7,264,210 B2 * 9/2007 Yu ..... A45F 3/44 135/16
7,722,286 B2 * 5/2010 Heald ..... E04H 12/2269 40/612
7,780,139 B2 * 8/2010 Markert ..... E04H 12/2261 135/15.1
8,123,190 B2 * 2/2012 Kost ..... A45B 11/00 135/88.08
D685,315 S * 7/2013 Hayes ..... D12/415
8,595,973 B1 * 12/2013 Kunz ..... A01K 97/10 248/514
8,714,511 B2 * 5/2014 Zoeteman ..... A45B 23/00 135/16
8,950,723 B1 2/2015 Fogeistrorn et al.
8,978,676 B2 * 3/2015 Williams ..... E04H 12/2238 135/16
9,212,501 B2 * 12/2015 Walker ..... E04H 12/2238
9,371,619 B2 * 6/2016 Intagliata ..... E01F 9/608
D834,806 S * 12/2018 Spafford ..... D3/10
(Continued)

FOREIGN PATENT DOCUMENTS

CA 2423742 A1 6/2004
CA 2423753 A1 6/2004

*Primary Examiner* — Bradley Duckworth
(74) *Attorney, Agent, or Firm* — Gearhart Law, LLC

(57) ABSTRACT

Disclosed embodiments provide an outdoor umbrella mount comprising a hollow tubular portion. Multiple access mounting holes are disposed within the tubular portion. A base screw is configured and disposed to traverse a mounting hole and an opposite mounting hole to serve as the base for an umbrella, allowing an umbrella to be securely mounted without the need for a large base on the floor/ground surface, thereby creating more legroom area for users.

19 Claims, 9 Drawing Sheets

(56) References Cited

U.S. PATENT DOCUMENTS

| | | | | |
|---|---|---|---|---|
| 2001/0017150 | A1* | 8/2001 | Doreste | A45B 17/00 135/15.1 |
| 2004/0169121 | A1* | 9/2004 | Winn | A45B 1/00 248/530 |
| 2005/0218285 | A1* | 10/2005 | Yorns | B25H 3/006 248/314 |
| 2007/0034758 | A1 | 2/2007 | Bates | |
| 2007/0108364 | A1* | 5/2007 | Metheny | A45B 11/00 248/541 |
| 2008/0029137 | A1* | 2/2008 | McInville | E04H 12/2269 135/16 |
| 2009/0314910 | A1* | 12/2009 | Jeanveau | A45B 11/00 248/231.71 |
| 2012/0132779 | A1* | 5/2012 | Johnson | E04H 12/2269 248/513 |
| 2018/0016808 | A1* | 1/2018 | Hilliard | E04H 12/2238 |
| 2018/0106062 | A1* | 4/2018 | Brady | E04H 12/2215 |

* cited by examiner

OUTDOOR UMBRELLA MOUNT

CLAIM OF PRIORITY

This application is a non-provisional application and claims priority to no other foreign or domestic patent or patent application.

FIELD OF THE EMBODIMENTS

The present invention and its embodiments relate generally to outdoor umbrella mounts, mounted brochettes, and stands.

BACKGROUND

Outdoor umbrellas are often used on patios, decks, in gardens, and other recreation and work areas for providing shade and/or shelter from sun and in some cases rain. These umbrellas enable enhanced enjoyment of these spaces by increasing comfort as well as protecting users from the sun's harmful rays. It is therefore desirable to have improvements in umbrella stands.

SUMMARY

Disclosed embodiments provide a secure mounting for various types of outdoor umbrellas and can be used in place of a weighted umbrella stand. The primary benefits are that it can be easily mounted to a secure post, not taking up floor space or causing a trip hazard and can be positioned between users, and the sun so as to provide shade at desired angles to all users. Disclosed embodiments can provide a cost-effective alternative to umbrella stands and used in place of expensive awnings.

Embodiments include an umbrella mount, comprising: a hollow tubular portion; a plurality of mounting holes disposed within the tubular portion; a plurality of threaded screws, wherein each threaded screw from the plurality of threaded screws is configured and disposed to traverse an access hole from the plurality of mounting holes; and a base screw configured and disposed to traverse the mounting holes aligned at the bottom of the tubular portion and opposite mounting hole from the plurality of mounting holes.

In some embodiments, the hollow tubular portion is comprised of PVC plastic.

In some embodiments, the hollow tubular portion has a length ranging from 18 inches to 35 inches.

In some embodiments, the hollow tubular portion has an inner diameter ranging between 1.5 inches and 3.5 inches.

In some embodiments, the hollow tubular portion has a wall thickness ranging from ⅛ inch to ¾ inch.

In some embodiments, the plurality of mounting holes comprises a plurality of large diameter access holes, and a corresponding plurality of small diameter mounting holes oriented opposite to the large diameter mounting holes.

In some embodiments, each large diameter access hole from the plurality of large diameter mounting holes has a diameter ranging from ½ inches to 1 inches.

In some embodiments, each small diameter mounting hole from the plurality of small diameter mounting holes has a diameter ranging from ¼ inches to ⅓ inches.

Embodiments may further include an umbrella anchor screw configured and disposed to engage an umbrella rod.

In some embodiments, the umbrella anchor screw includes a wing nut.

In some embodiments, the umbrella anchor screw includes a thumbscrew.

Figure 1B:
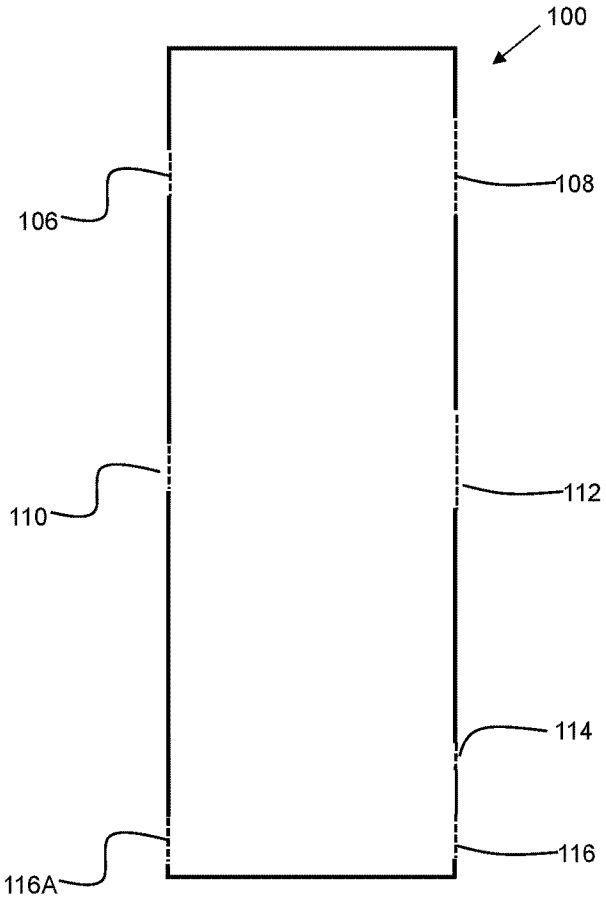
FIG. 1B is a side cutaway view of the umbrella mount of FIG. 1A

The drawings are not necessarily to scale. The drawings are merely representations, not necessarily intended to portray specific parameters of the invention. The drawings are intended to depict only example embodiments of the invention, and therefore should not be considered as limiting in scope. In the drawings, like numbering may represent like elements. Furthermore, certain elements in some of the figures may be omitted, or illustrated not-to-scale, for illustrative clarity.

DETAILED DESCRIPTION

Figure 1A:
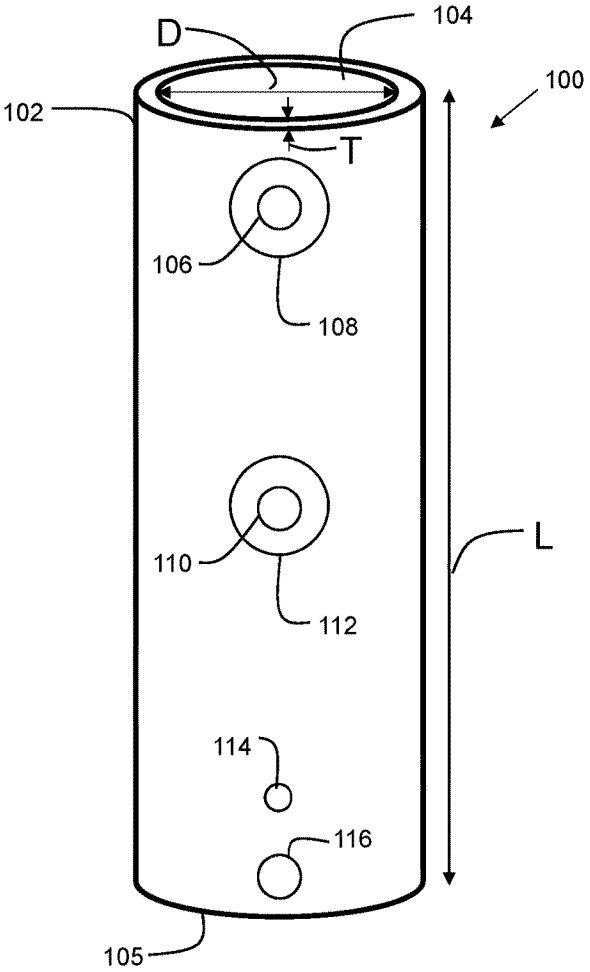
FIG. 1A is a front view of an umbrella mount in accordance with embodiments of the present invention.

FIG. 1A is a front view of an outdoor umbrella mount 100 in accordance with embodiments of the present invention, and FIG. 1B is a side cutaway view of the umbrella mount of FIG. 1A. In embodiments, outdoor umbrella mount 100 is formed as a hollow tubular portion 102 having opening 104 at the top side for receiving an umbrella pole. In embodiments, the hollow tubular portion comprises a cylindrical shape. In embodiments, the bottom side 105 may be open as well, to allow any rainwater to drain.

On a front surface, a plurality of holes is formed within the side of the holder 102 to facilitate mounting and securing of an umbrella. Large diameter hole 108 and large diameter hole 112 are formed on the front surface to facilitate installation of screws. In embodiments, the large diameter holes are each ½ inch to 1 inch in diameter. Corresponding small diameter holes 106 and 110 are formed opposite to where the large diameter holes 108 and 112 are formed. In embodiments, the plurality of mounting holes comprises a plurality of large diameter tool access holes, and a corresponding plurality of small diameter holes oriented opposite to the large diameter holes. In embodiments, the small diameter holes are each ¼ inch in diameter. In some embodiments, each large diameter mounting hole has a diameter ranging from ½ to 1 inches. In some embodiments, each small diameter mounting hole has a diameter ranging from ¼ to ⅓ inches.

Base hole 116 has corresponding base hole 116A on opposite side. In embodiments, base hole 116 and base hole 116A are of similar diameter to the small diameter holes 106 and 110. A securing slot 114 is disposed on the front side for receiving an umbrella thumb screw that can engage with an umbrella rod.

In embodiments, the tubular portion 102 is comprised of a PVC (polyvinyl chloride or similar plastic such as high-density polyethylene—HDPE, plastic polymer or composite of similar strength) cylinder. In embodiments, the tubular portion 102 has a length L ranging from 18 inches (46 cm) to 35 inches (89 cm). In embodiments, the tubular portion 102 has an inner diameter D ranging between 1.5 (38 mm) inches and 3.5 inches (90 mm) in various colors including white, black and brown, and a wall thickness T ranging from ⅛ inch (3.175 mm) to ¾ inch (19 mm). Other dimensions are possible in some embodiments. Each bolt and/or screw and washer may be comprised of stainless steel and/or galvanized steel in some embodiments. In some embodiments, some of the bolts/screws may include self-starting tips to facilitate easy installation into a wooden surface such as a support post for a fence or deck rail.

Figure 1D:
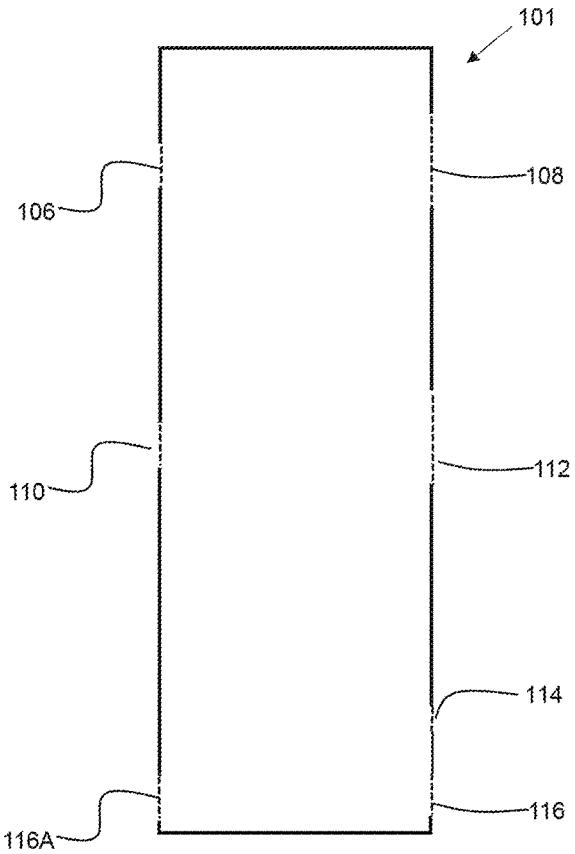
FIG. 1D is a side cutaway view of the umbrella mount of FIG. 1C.
Figure 1C:
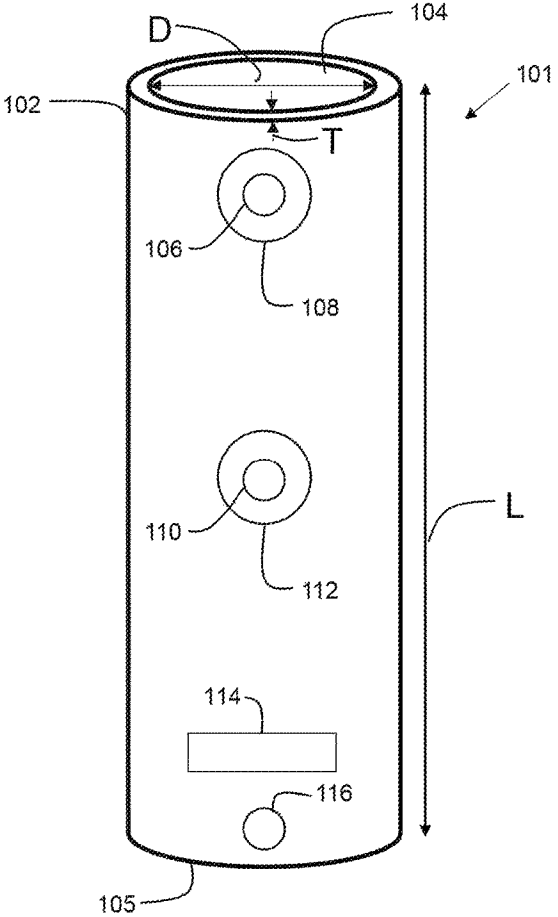
FIG. 1C is a front view of an umbrella mount in accordance with additional embodiments of the present invention.

FIG. 1C is a front view of an umbrella mount 101 in accordance with additional embodiments of the present invention. FIG. 1D is a side cutaway view of the umbrella mount of FIG. 1C. Umbrella holder 101 is similar to outdoor umbrella mount 100 shown in FIG. 1A, with a difference being that in place of the securing slot 114, there is ¼ inch securing slot 114. The securing slot 114 provides flexibility in angle adjustment of an umbrella. As shown in FIG. 1C, the securing slot 114 is formed with a rectangle with respect to the orientation of the umbrella mount 101. Alternatively, the securing slot 114 may have a crescent shape.

Figure 2A:
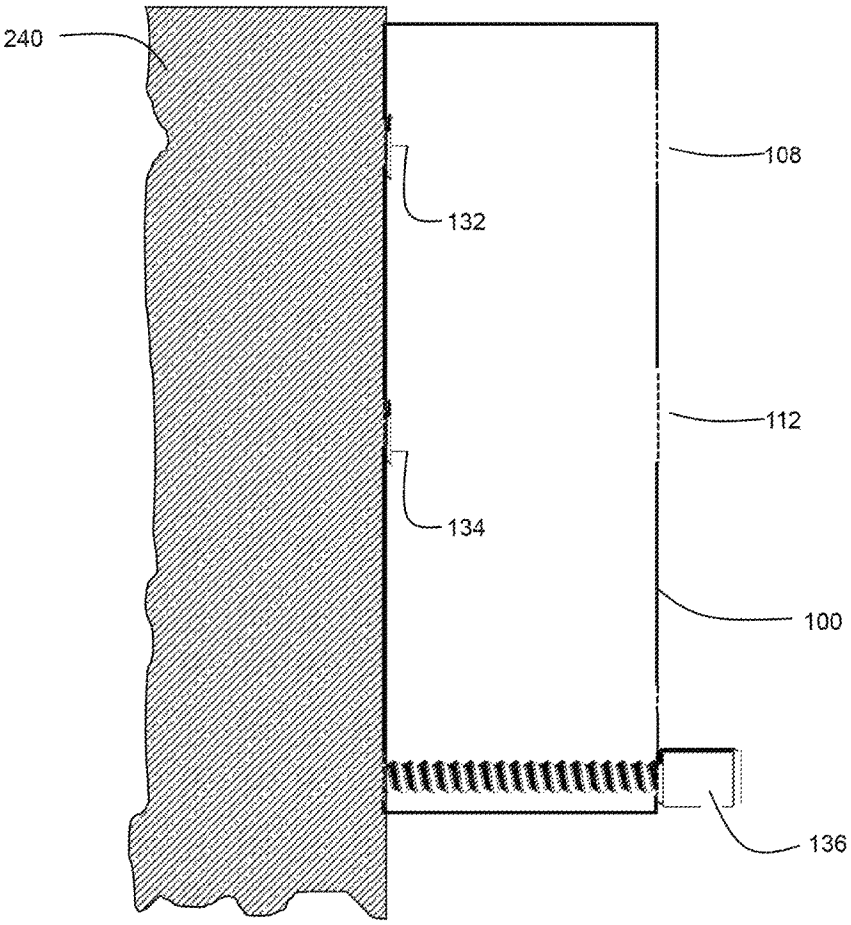
FIG. 2A is a side cutaway view of the umbrella mount of FIG. 1A shown mounted to a vertical surface.
Figure 2B:
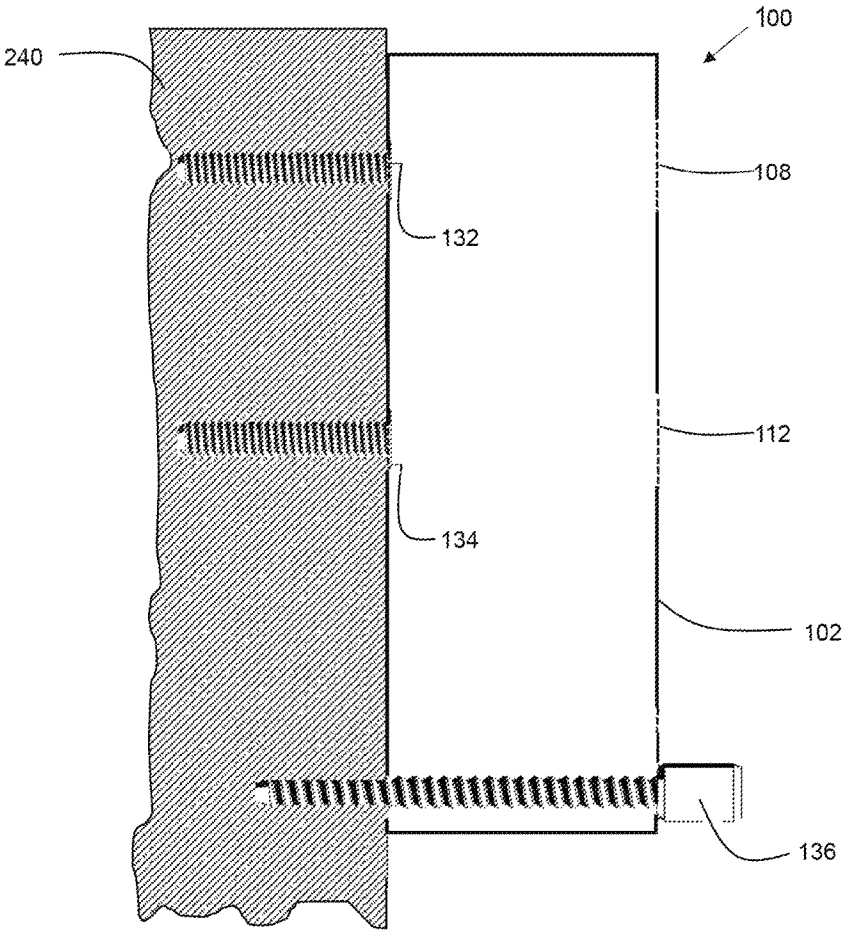
FIG. 2B is a side cutaway view of the umbrella mount of FIG. 2A showing screw penetration.

FIG. 2A is a side cutaway view of the outdoor umbrella mount 100 of FIG. 1A shown mounted to a vertical surface 240. Similarly, FIG. 2B is a side cutaway view of the umbrella mount of FIG. 2A showing screw penetration. In embodiments, vertical surface 240 can include a wall, post, fence, or other suitable vertical surface capable of supporting an outdoor umbrella. Installation screws 132 and 134 fasten the tubular portion 102 to the vertical surface 240 by traversing holes 106 and 110 respectively. The installation screws 132 and 134 may include flathead screws to allow an outdoor umbrella to freely slide into the outdoor umbrella mount 100. To install the umbrella mount, each installation screws 132 and 134 is placed through the respective large diameter hole 108 and 112. The screws 132 and 134 are threaded to engage into the vertical surface 240. In embodiments, vertical surface 240 is comprised of wood. In embodiments, the vertical surface 240 is comprised of pressure-treated wood to provide the strength for supporting the umbrella mount. Base screw 136 traverses hole 116 and 116A to engage the vertical surface 240 at the lower end of the tubular portion 102. The vertical surface 240 may also include other suitable decking or mounting materials of sufficient strength.

Figure 3A:
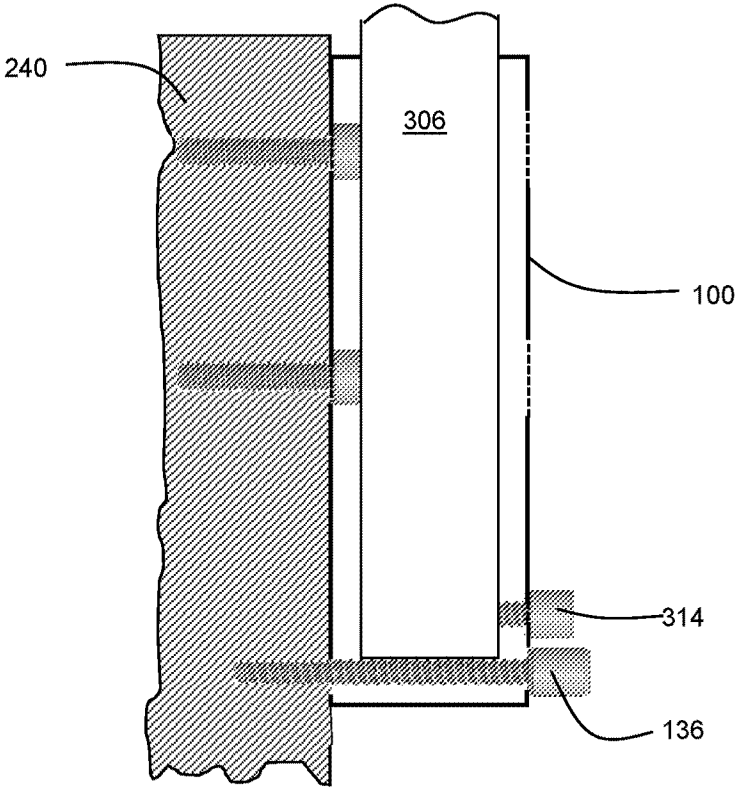
FIG. 3A and FIG. 3B show an umbrella mount in accordance with embodiments of the present invention with an umbrella rod disposed therein.
Figure 3B:
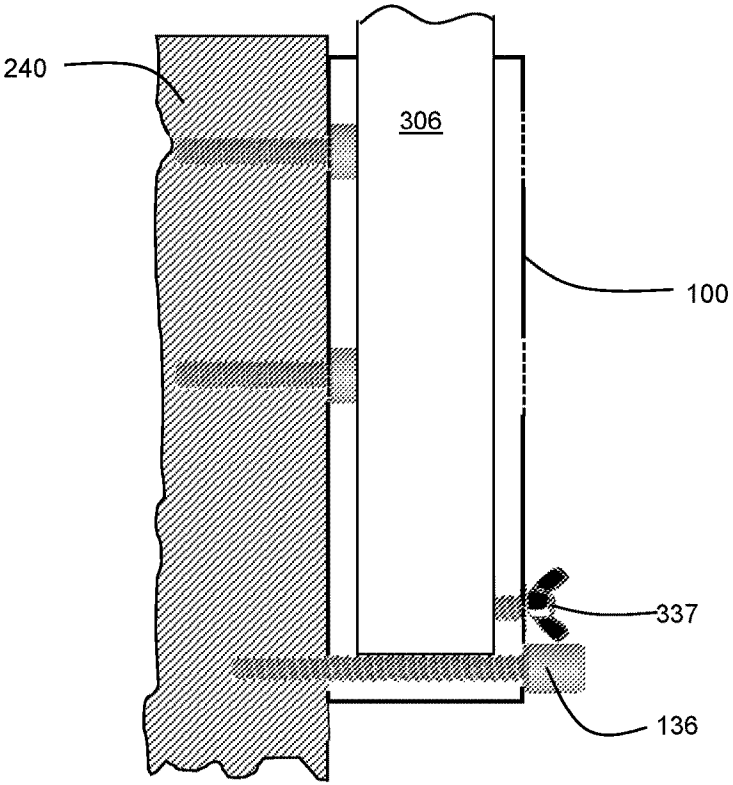
Figure 3C:
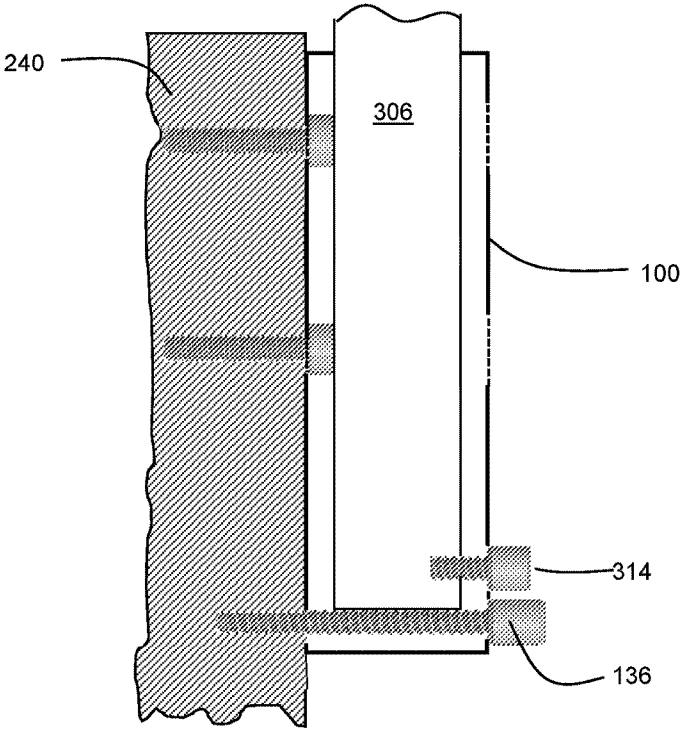
FIG. 3C shows an additional embodiment of the present invention.

FIG. 3A shows an outdoor umbrella mount 100 in accordance with embodiments of the present invention with an umbrella rod 306 disposed therein. The umbrella rod 306 may be installed so as to contact base screw 136. To further secure the umbrella rod 306 within the outdoor umbrella mount 100, an umbrella thumb screw 314 may be installed through slot 114 such that it inserts into the umbrella rod 306 to keep it firmly held within the tubular portion 102. In embodiments, the umbrella thumb screw 314 may comprise a thumbscrew or wing nut. FIG. 3B is similar to FIG. 3A, except that umbrella thumb screw 337 utilizes a wing nut to facilitate easy installation and uninstallation of the umbrella rod 306. FIG. 3B is similar to FIG. 3A, except that in this embodiment, umbrella thumb screw 314 engages with a corresponding hole in the umbrella rod 306 to traverse the umbrella rod 306 to provide additional security. In FIG. 3C, the umbrella thumb screw 314 traverses the umbrella rod 306 and the securing slot. The securing slot enables a finer adjustment of the position of the umbrella rod 306 by providing a flexibility in angle adjustment of the umbrella rod 306.

Figure 4:
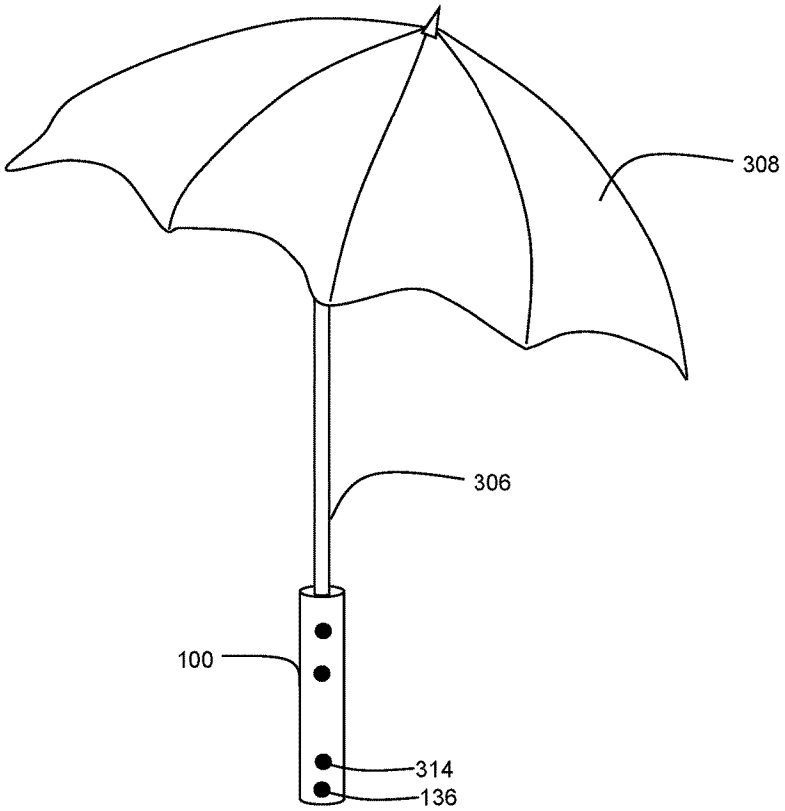
FIG. 4 shows an umbrella installed within an umbrella mount in accordance with embodiments of the present invention.

FIG. 4 shows an umbrella 308 installed within an outdoor umbrella mount 100 in accordance with embodiments of the present invention. The umbrella rod 306 is disposed within the tubular portion 102, resting on base screw 136 and held in place by umbrella thumb screw 314. During use, the umbrella thumb screw will allow rotation of the umbrella corresponding to the sun angle, and the umbrella thumb screw may also be removed to allow removal of the umbrella to another location.

Figure 5:
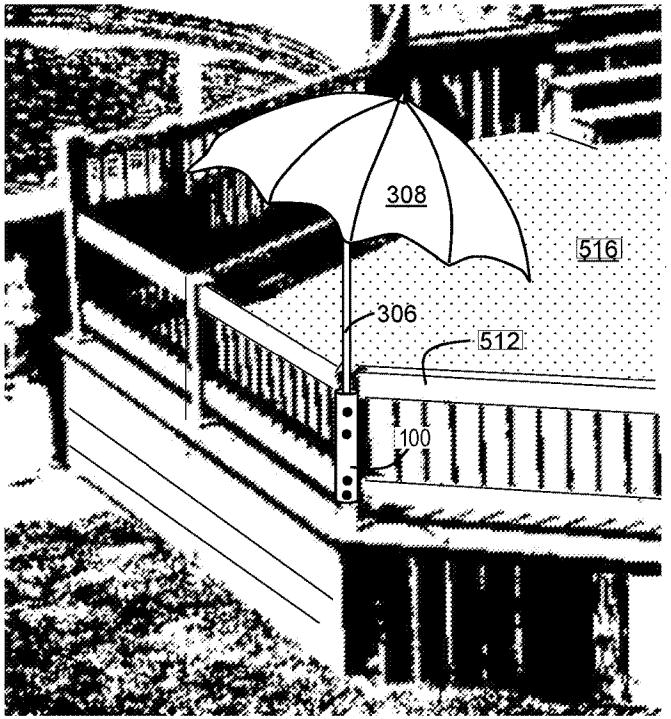
FIG. 5 shows an outdoor umbrella installed on a post of a deck rail with an umbrella mount in accordance with embodiments of the present invention.

FIG. 5 shows an outdoor umbrella 308 installed on a post of a deck rail 512 with an outdoor umbrella mount 100 in accordance with embodiments of the present invention. The umbrella rod 306 is inserted into the outdoor umbrella mount 100 and provides shade and/or shelter for the deck area 516, without the need for a cumbersome base. In some embodiments, shims and/or washers may be used to clear top rail overhangs.

As can now be appreciated, with embodiments of the present invention, an umbrella 308 can be easily and quickly installed in the outdoor umbrella mount 100 to provide shade and shelter. Similarly, the umbrella 308 can be removed quickly and easily for storage when not needed. Furthermore, embodiments of the present invention allow an umbrella to be mounted higher than a conventional umbrella stand, thereby increasing the size of the shaded area.

When introducing elements of the present disclosure or the embodiment(s) thereof, the articles "a," "an," and "the" are intended to mean that there are one or more of the elements. Similarly, the adjective "another," when used to introduce an element, is intended to mean one or more elements. The terms "including" and "having" are intended to be inclusive such that there may be additional elements other than the listed elements.

Although this invention has been described with a certain degree of particularity, it is to be understood that the present disclosure has been made only by way of illustration and that numerous changes in the details of construction and arrangement of parts may be resorted to without departing from the spirit and the scope of the invention.

What is claimed is:

1. An umbrella mount, comprising:

a hollow tubular portion having an open top and an open bottom;

a plurality of access holes disposed within the tubular portion;

a plurality of mounting holes disposed within the tubular portion;

a plurality of threaded screws, wherein each threaded screw from the plurality of threaded screws is configured to align with and disposed to traverse both a mounting hole and an access hole; and a base screw configured and disposed to traverse at least one base hole, wherein the at least one base hole is located below the plurality of mounting holes and access holes and near the open bottom of the hollow tubular portion;

wherein the plurality of access holes are aligned with the plurality of mounting holes.

2. The umbrella mount of claim 1, wherein the hollow tubular portion is comprised of polymers, composites, or metals.

3. The umbrella mount of claim 1, wherein the hollow tubular portion has a length ranging from 18 inches to 35 inches.

4. The umbrella mount of claim 1, wherein the hollow tubular portion is cylindrical.

5. The umbrella mount of claim 4, wherein the hollow tubular portion has an inner diameter ranging between 1.5 inches and 3.5 inches.

6. The umbrella mount of claim 4, wherein the hollow tubular portion has a wall thickness ranging from ⅛ inch to ¾ inch.

7. The umbrella mount of claim 1, wherein there are a plurality of access holes comprised of a plurality of large diameter openings, and a plurality of mounting holes comprised of a plurality of small diameter openings oriented opposite to the large diameter access holes.

8. The umbrella mount of claim 7, wherein each large diameter access hole from the plurality of large diameter access holes has a diameter ranging from ½ to 1 inch.

9. The umbrella mount of claim 7, wherein each small diameter mounting hole from the plurality of small diameter mounting holes has a diameter ranging from ¼ to ⅓ inches.

10. The umbrella mount of claim 1, further comprising an umbrella thumb screw configured and disposed to engage an umbrella rod.

11. The umbrella mount of claim 10, wherein the umbrella thumb screw includes a wing nut.

12. The umbrella mount of claim 10, wherein the umbrella thumb screw includes a thumbscrew.

13. The umbrella mount of claim 1, further comprising a securing slot disposed on the umbrella mount.

14. An umbrella mount, comprising:

a hollow tubular portion having an open top and an open bottom;

a plurality of access holes disposed through the tubular portion;

a plurality of mounting holes disposed through the tubular portion;

a plurality of threaded screws, wherein each threaded screw from the plurality of threaded screws is configured and disposed to traverse both a mounting hole and an access hole of the hollow tubular portion; and a base screw configured and disposed to traverse a base hole and an opposite mounting base hole, wherein the plurality of access holes are aligned with the plurality of mounting holes along a length of the hollow tubular portion;

wherein a slot is disposed below the plurality of access holes and the plurality of mounting holes and above the base hole and the opposing mounting base hole.

15. The mount of claim 14 further comprising an umbrella thumb screw configured and disposed to engage an umbrella rod positioned within the hollow tubular portion.

16. The mount of claim 15 wherein the umbrella thumb screw engages the umbrella rod through the slot.

17. The mount of claim 16 wherein rotation of the umbrella thumb screw allows for rotation of the umbrella rod.

18. The mount of claim 14 further comprising at least one shim positioned between the hollow tubular portion and a mounting surface.

19. The mount of claim 14 wherein the plurality of mounting holes are sized such that the plurality of threaded screws, when traversing the plurality of mounting holes, will be flush with an interior surface of the hollow tubular portion.

* * * * *